United States Patent [19]

Terauchi

[11] Patent Number: 4,780,060

[45] Date of Patent: Oct. 25, 1988

[54] SLANT PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Gunma, Japan

[21] Appl. No.: 82,527

[22] Filed: Aug. 7, 1987

[30] Foreign Application Priority Data

Aug. 7, 1986 [JP] Japan ..... 61-184319

[51] Int. Cl.[4] ..... F04B 1/28

[52] U.S. Cl. ..... 417/222; 417/270

[58] Field of Search ..... 417/218, 222, 270

[56] References Cited

U.S. PATENT DOCUMENTS

| | | | |
|---|---|---|---|
| Re. 27,844 | 11/1968 | Olsen . | |
| 2,530,507 | 11/1950 | Campbell . | |
| 2,573,863 | 11/1951 | Mitchell . | |
| 3,047,696 | 7/1962 | Heidorn | 62/209 |
| 3,861,829 | 1/1975 | Roberts . | |
| 4,037,993 | 7/1977 | Roberts . | |
| 4,073,603 | 2/1978 | Abendschein . | |
| 4,145,163 | 3/1979 | Fogelberg . | |
| 4,174,191 | 11/1979 | Roberts . | |
| 4,425,837 | 1/1984 | Livesay . | |
| 4,428,718 | 1/1984 | Skinner . | |
| 4,433,596 | 2/1984 | Scalzo . | |
| 4,475,871 | 10/1984 | Roberts . | |
| 4,492,527 | 1/1985 | Swain . | |
| 4,526,516 | 7/1985 | Swain | 417/270 |
| 4,669,272 | 6/1987 | Kawai | 62/217 |
| 4,674,957 | 6/1987 | Ohta | 417/270 |
| 4,687,419 | 8/1987 | Suzuki | 417/270 |
| 4,688,997 | 8/1987 | Suzuki | 417/222 |
| 4,702,677 | 10/1987 | Tallewaka | 417/222 |

FOREIGN PATENT DOCUMENTS

| | | | |
|---|---|---|---|
| 3603931 | 8/1986 | Fed. Rep. of Germany | 417/222 |

*Primary Examiner*—William L. Freeh

*Attorney, Agent, or Firm*—Banner, Birch, McKie & Beckett

[57] ABSTRACT

A slant plate type refrigerant compressor, such as a wobble plate type compressor, with a variable displacement mechanism for use in a refrigeration circuit is disclosed. The compressor has a control mechanism to control the pressure in a crank chamber responsive to the pressure in the suction chamber, and another control mechanism to control the pressure in the crank chamber responsive to the temperature of refrigerant gas in the suction chamber. Therefore, the capacity of the compressor can be more accurately controlled in response to changes in the air conditioning load, such as the temperature in a passenger compartment of an automobile.

10 Claims, 3 Drawing Sheets

SLANT PLATE TYPE COMPRESSOR WITH VARIABLE DISPLACEMENT MECHANISM

TECHNICAL FIELD

The present invention relates to an improved refrigerant compressor for an automotive air conditioner. More particularly, the present invention relates to a slant type compressor, such as a wobble plate type compressor, with a variable displacement mechanism suitable for use in an automotive air conditioning system.

BACKGROUND OF THE INVENTION

One construction of a slant plate type compressor, particularly a wobble plate type compressor, with a variable capacity mechanism which is suitable for use in an automotive air conditioner is disclosed in U.S. Pat. No. 3,861,829 issued to Roberts et al. Roberts et al. '829 discloses a wobble plate type compressor which has a cam rotor driving device to drive a plurality of pistons. The slant or incline angle of the slant surface of the wobble plate is varied to change the stroke length of the pistons which changes the displacement of the compressor. Changing the incline angle of the wobble plate is effected by changing the pressure difference between the suction chamber and the crank chamber in which the driving device is located.

In such a prior art compressor, the slant angle of the slant surface is controlled by the pressure in the crank chamber. Typically this control occurs in the following manner. The crank chamber communicates with the suction chamber through an aperture and the opening and closing of the aperture is controlled by a valve mechanism. The valve mechanism generally includes a bellows element and a needle valve, and is located in the suction chamber so that the bellows element operates in accordance with changes in the suction chamber pressure.

In the above compressor, the pressure in the suction chamber is compared with a predetermined value by the valve mechanism. However, when the predetermined value is below a certain critical value, there is a possibility of frost forming on the evaporator in the refrigerant circuit. Thus, the predetermined value is usually set higher than this critical value to prevent frost from forming on the evaporator.

However, since suction pressures above this critical value are higher than the pressure in the suction chamber when the compressor operates at maximum capacity, the cooling characteristics of the compressor are inferior to those of the same compressor without a variable displacement mechanism. That is, if the temperature in the passenger compartment of an automobile is high, the pressure in the suction chamber of the compressor usually becomes high. However, if the compressor is driven at high capacity and at high rotational speeds, the pressure in the suction chamber decreases even though the temperature in the passenger compartment of the automobile and the thermal load for the evaporator are still high. Therefore, the variable displacement mechanism operates to decrease the capacity even as the environmental conditions require an increased cooling capacity of the compressor. The cooling operation in the passenger compartment of the automobile is therefore insufficient.

Roberts et al. '829 discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber can be used in any type of compressor which uses a slanted plate or surface in the drive mechanism. For example, U.S. Pat. No. 4,664,604 issued to Terauchi discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used to refer to any type of compressor, including wobble and swash plate types, which use a slanted plate or surface in the drive mechanism.

SUMMARY OF THE INVENTION

It is a primary object of this invention to provide a slant plate type compressor with a variable displacement mechanism which can better control the temperature in a passenger compartment of a vehicle.

It is another object of this invention to provide a slant plate type compressor with a variable displacement mechanism which has improved cooling characteristics.

A slant plate type compressor in accordance with the present invention includes a compressor housing having a front end plate at one of its ends and a rear end plate at its other end. A crank chamber and a cylinder block are located in the housing, and a plurality of cylinders are formed in the cylinder block. A piston is slidably fitted within each of the cylinders and is reciprocated by a driving mechanism. The driving mechanism includes a drive shaft, a drive rotor coupled to the drive shaft and rotatable therewith, and a coupling mechanism which drivingly couples the rotor to the pistons such that the rotary motion of the rotor is converted to reciprocating motion of the pistons. The coupling mechanism includes a member which has a surface disposed at an incline angle relative to the drive shaft. The incline angle of the member is adjustable to vary the stroke length of the reciprocating pistons and thus vary the capacity or displacement of the compressor. The rear end plate surrounds a suction chamber and a discharge chamber.

The displacement control device includes at least one passageway and two control mechanisms. The first control mechanism controls the pressure in the crank chamber responsive to the pressure in the suction chamber. The second control mechanism controls the pressure in the crank chamber responsive to the temperature of the refrigerant gas in the suction chamber.

Various additional advantages and features of novelty which characterize the invention are further pointed in the claims that follow. However, for a better understanding of the invention and its advantages, reference should be made to the accompanying drawings and descriptive matter which illustrate and describe preferred embodiments of the invention.

BRIEF DESCRIPTION OF THE DRAWINGS

FIG. 3(*b*) illustrates the relationship between time and the capacity of a slant plate type compressor with a conventional variable displacement mechanism as compared with a slant plate type compressor with a variable displacement mechanism in accordance with the present invention.

FIG. 3(*c*) illustrates the relationship between time and the temperature in a passenger compartment of a car with a slant plate type compressor with a conventional variable displacement mechanism as compared with a slant plate type compressor within a variable displacement mechanism in accordance with the present invention.

DETAILED DESCRIPTION OF PREFERRED EMBODIMENTS

Figure 1:
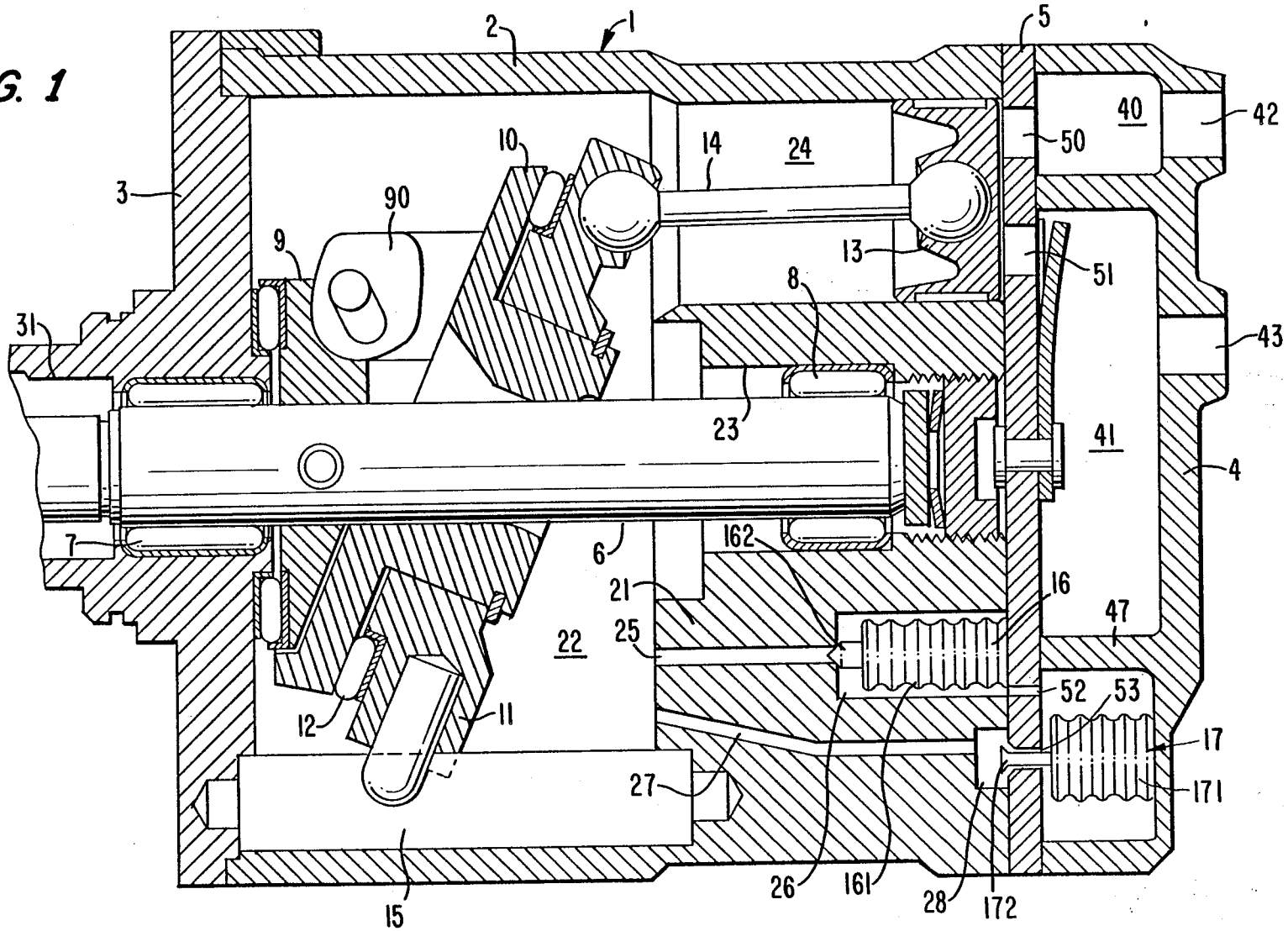
FIG. 1 is a cross-sectional view of a slant plate type compressor with a variable displacement mechanism in accordance with one embodiment of this invention.

Referring to FIG. 1, the construction of a slant plate type compressor, specifically a wobble plate type compressor, with a variable displacement mechanism according to one embodiment of this invention is shown. Compressor 1 includes a closed housing assembly formed by cylindrical compressor housing 2, front end plate 3, and a rear end plate in the form of cylinder head 4. Cylinder block 21 and crank number 22 are formed on compressor housing 2. Front end plate 3 is attached to one end surface of compressor housing 2, and cylinder head 4, which is disposed on the other end surface of compressor housing 2, is fixed on one end surface of cylinder block 21 through valve plate 5. Opening 31 is formed in the central portion of front end plate 3 to penetrate drive shaft 6.

Drive shaft 6 is rotatably supported within front end plate 3 through bearing 7. A shaft seal (not shown) is disposed between the inner surface of opening 31 and the outer surface of drive shaft 6 at the outside of bearing 7. An inner end portion of drive shaft 6 extends into central bore 23 formed in the central portion of cylinder block 21 and is rotatably supported therein through bearing 8. Rotor 9, which is disposed in the interior of crank chamber 22, is connected to drive shaft 6 to be rotatable therewith and engages inclined plate 10 on one side surface through hinge portion 90. The incline angle of inclined plate 10 with respect to drive shaft 6 can be adjusted by hinge portion 90. Wobble plate 11 is disposed on the other side surface of inclined plate 10 and bears against it through bearing 12.

A plurality of cylinders 24, one of which is shown in FIG. 1, are equiangularly formed in cylinder block 21, and piston 13 is reciprocatingly disposed within each cylinder 24. Each piston 13 is connected to wobble plate 11 through connecting rod 14. One end of each connecting rod 14 is connected to wobble plate 12 with a ball joint and the other end of each connecting rod 14 is connected to one of pistons 13 with a ball joint. Guide bar 15 extends within crank chamber 22 of compressor housing 2. The lower end portion of wobble plate 11 engages guide bar 15 to enable wobble plate 11 to reciprocate along guide bar 15 while preventing rotating motion.

Pistons 13 are thus reciprocated in cylinders 24 by a drive mechanism formed of drive shaft 6, rotor 9, inclined plate 10, wobble plate 11, and connecting rods 14. Drive shaft 6 and rotor 9 rotate. Inclined plate 10, wobble plate 11, and connecting rods 14 function as a coupling mechanism to convert the rotating motion of the rotor into reciprocating motion of the pistons.

Cylinder head 4 has an interior space divided into at least two chambers, suction chamber 40 and discharge chamber 41. Suction chamber 40 and discharge chamber 41 are divided by partition wall 47, and both chambers communicate with cylinders 24 through suction holes 50 and discharge holes 51 formed through valve plate 5, respectively. Also, cylinder head 4 is provided with inlet port 42 and outlet port 43 which place suction chamber 40 and discharge chamber 41 in fluid communication with an external refrigerant circuit.

First passageway 25 is formed within cylinder block 21 to communicate between crank chamber 22 and suction chamber 40. Communication is established through first hollow portion 26 formed within cylinder block 21, and first communication hole 52 formed through valve plate 5. The communication between chambers 22 and 40 is controlled by first control device 16. First control device 16 is located in first hollow portion 26 and includes bellows 161 and needle valve 162. One end surface of bellows 161 is attached to one inner end surface of first hollow portion 26. Needle valve 162 is fixed on the other end surface of bellows 161 and operates to open and close first passageway 25 in accordance with the motion of bellows 161. The interior of bellows 161 is maintained as a vacuum to prevent operating in accordance with the temperature of refrigerant gas in suction chamber 40. Bellows 161 is provided with a coil spring (not shown) which determines its operating point, a predetermined pressure Ps1.

Second passageway 27 is formed within cylinder block 21 to communicate between crank chamber 22 and suction chamber 40 through second hollow portion 28 formed within cylinder block 21, and second communication hole 53 formed through valve plate 5. The communication between crank chamber 22 and suction chamber 40 is controlled by second control device 17. Second control device 17 includes bellows 171 and tappet valve 172. Bellows 171 is located in suction chamber 40 to correctly detect the temperature of refrigerant gas in suction chamber 40. One end surface of bellows 171 is attached to one end surface of cylinder head 4. Tappet valve 172 is fixed on the other end surface of bellows 171 and extends within the interior of second hollow portion 28 to control the opening and closing of second communication hole 53 in accordance with the motion of bellows 171. Gas with a low saturated vapor pressure, such as refrigerant, is enclosed in the interior of bellows 171 to operate bellows 171 in accordance with the temperature of the refrigerant in suction chamber 40. The temperature of the refrigerant inside bellows 171 varies to equal the temperature of refrigerant in suction chamber 40.

When the refrigerant in suction chamber 40 is in a state of wet gas, i.e., saturated vapor, the refrigerant enclosed in bellows 171 is a saturated vapor, and the pressure of the refrigerant in bellows 171 decreases to a level equal to that in suction chamber 40. The inherent stiffness or bias of bellows 171 is selected so that under these conditions, when the pressure in bellows 171 equals (or is less than) the pressure in suction chamber 40, bellows 171 contracts. Therefore, tappet valve 172 closes second communication hole 53.

If refrigerant gas in suction chamber 40 is in a saturated vapor state, it is not superheated. Communication between crank chamber 22 and suction chamber 40 through second passageway 27 is obstructed. Thus, communication between crank chamber 22 and suction chamber 40 is controlled in accordance with the operation of first control device 16 responsive to the pressure in suction chamber 40.

If the pressure in suction chamber 40 is below the predetermined operating pressure Ps1 of bellows 161, i.e., the recoil strength of bellows 161 is greater than the gas pressure in hollow portion 26, bellows 161 expands to the left, and needle valve 162 closes first passageway 25. Therefore, the communication between crank chamber 22 and suction chamber 40 through both first bypass hole 25 and second bypass hole 27 is obstructed. In contrast, when the pressure in suction chamber 40 is greater than the predetermined operating pressure Ps1, bellows 161 contracts to the right, and needle valve 162 opens first passageway 25. Therefore, communication between crank chamber 22 and suction chamber 40 through first passageway 25 is maintained.

When the temperature of refrigerant gas in suction chamber 40 increases, the temperature of the refrigerant inside bellows 171 also increases and the refrigerant gas enclosed in bellows 171 and in suction chamber 40 is in a dry gas state, i.e., superheated gas. Because bellows 171 is sealed, the vapor pressure of refrigerant enclosed in bellows 171 increases. Therefore, bellows 171 expands and pushes or biases tappet valve 172 to the left, second communication hole 53 is opened, and communication between crank chamber 22 and suction chamber 40 through second passageway 27 is established.

Thus, when refrigerant in suction chamber 40 is superheated and communication between crank chamber 22 and suction chamber 40 through second passageway 27 is maintained, communication is maintained regardless of the operation of first control device 16 which operates in response to the pressure in suction chamber 40.

Figure 2:
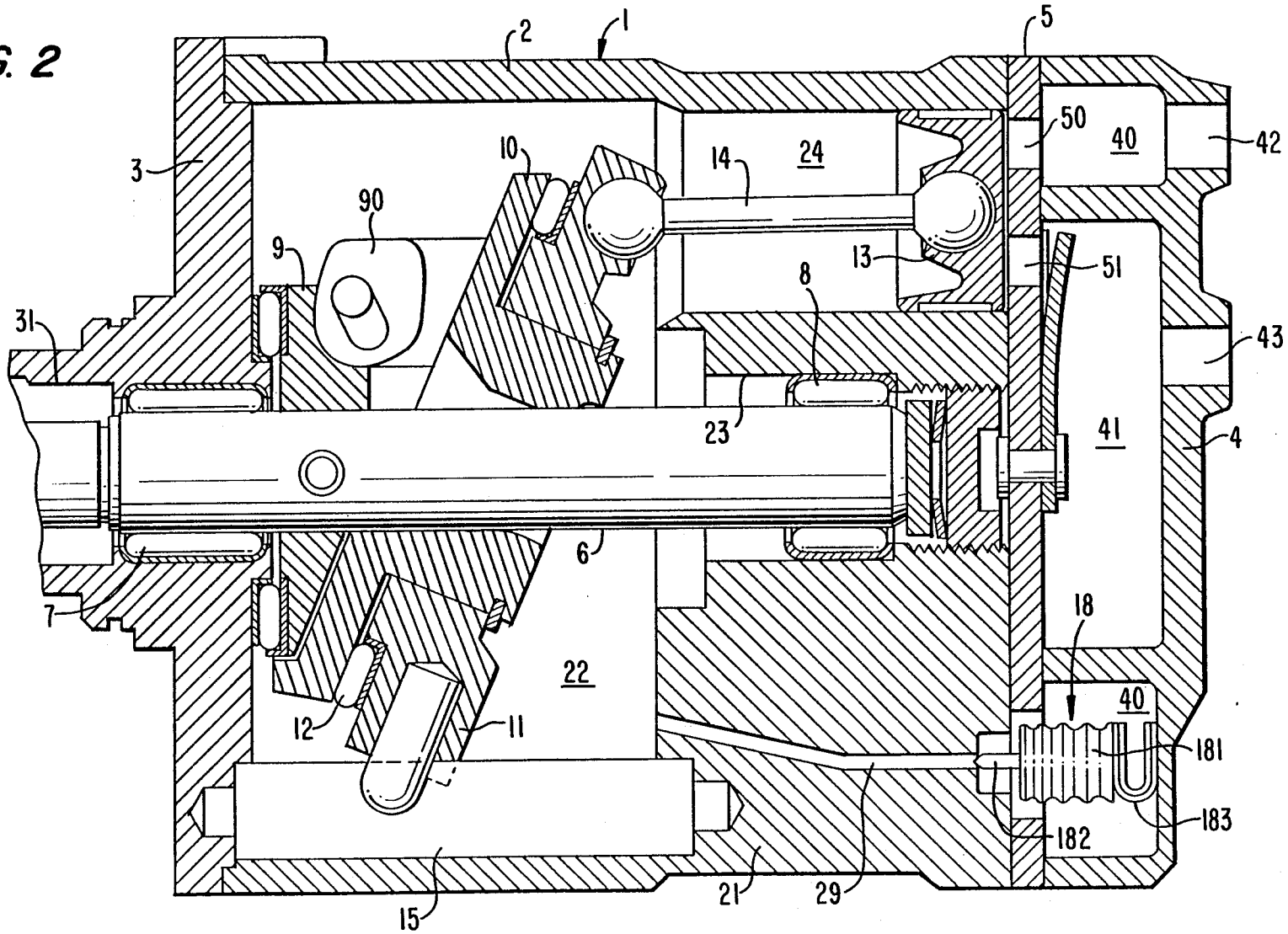
FIG. 2 is a cross-sectional view of a slant plate type compressor with a variable displacement mechanism in accordance with another embodiment of this invention.

Referring to FIG. 2, a slant plate type compressor with a variable displacement mechanism in accordance with a second embodiment of this invention is shown. One passageway 29 is formed within cylinder block 21 to communicate between crank chamber 22 and suction chamber 40. The communication between crank chamber 22 and suction chamber 40 is controlled by control device 18. Control device 18 is located in suction chamber 40 and includes bellows 181, needle valve 182 affixed on one end surface of bellows 181, and U-shaped sensing board 183. One end surface of U-shaped sensing board 183 is disposed against an adjacent end surface of bellows 181 and the other end surface of U-shaped sensing board 183 is attached to an inner end surface of suction chamber 40.

The interior of bellows 181 is maintained as a vacuum to prevent operating the compressor in accordance with the temperature of refrigerant gas in suction chamber 40. Bellows 181 is provided with a coil spring (not shown) in the inside thereof to determine its operating point. When the pressure in suction chamber 40 is less than the predetermined operating pressure of bellows 181, bellows 181 expands to the left and closes second communication hole 53. In contrast, when the pressure in suction chamber 40 is greater than the predetermined operating pressure of bellows 181, bellows 181 contracts to the right and opens second communication hole 53.

U-shaped sensing board 183 is a bimetallic element having the metal with a higher coefficient of thermal expansion on the outside. Therefore the position of bellows 181 changes in accordance with the refrigerant temperature change in suction chamber 40. That is, U-shaped sensing board 183 expands and pulls bellows 181 away from passageway 29 when the temperature rises in suction chamber 40, and conversely pushes bellows 181 toward passageway 29 when temperatures drop in suction chamber 40.

In this construction, if the pressure in suction chamber 40 is less than the predetermined operating pressure of bellows 181, bellows 181 expands to the left and needle valve 182 closes passageway 29. At that time, if the temperature of the refrigerant gas in suction chamber 40 is higher than a predetermined temperature, as determined by the coefficients of thermal expansion of U-shaped sensing board 183, and the refrigerant gas in suction chamber 40 is superheated, the left end of U-shaped sensing board 183 bends toward the right. That is, bellows 181 is shifted toward the right together with valve element 182. Passageway 29 is thus opened to allow communication between crank chamber 22 and suction chamber 40.

When the refrigerant gas in suction chamber 40 is not superheated, U-shaped sensing board 183 contracts. Therefore, communication between crank chamber 22 and suction chamber 40 is controlled by the operation of bellows element 181 responsive to the pressure in suction chamber 40.

Figure 3A:
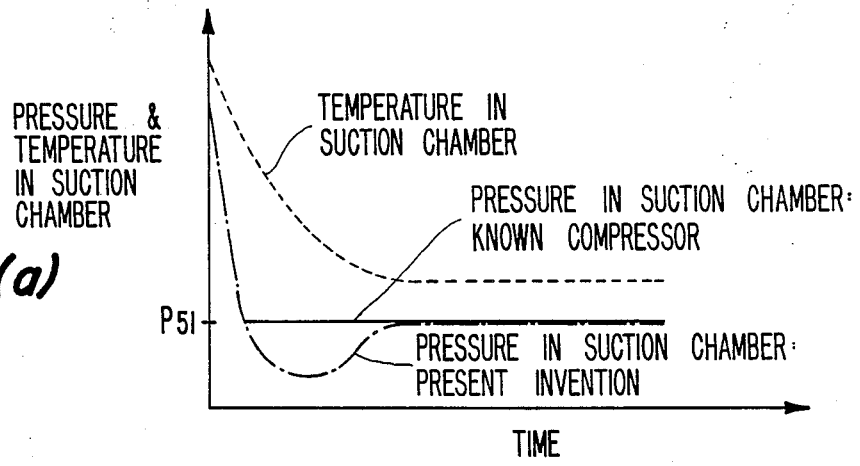
FIG. 3(*a*) illustrates the relaionship between time and the pressure or temperature of refrigerant gas in the suction chamber of a slant plate type compressor with a conventional variable displacement mechanism as compared with a slant plate type compressor with a variable displacement mechanism in accordance with the present invention.
Figure 3B:
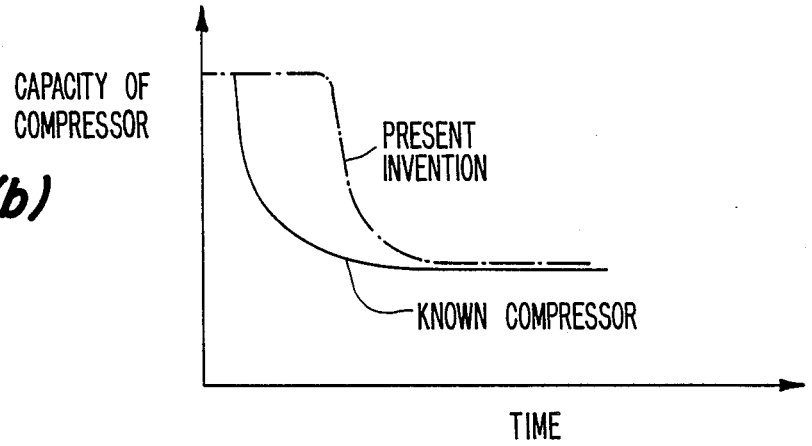
Figure 3C:
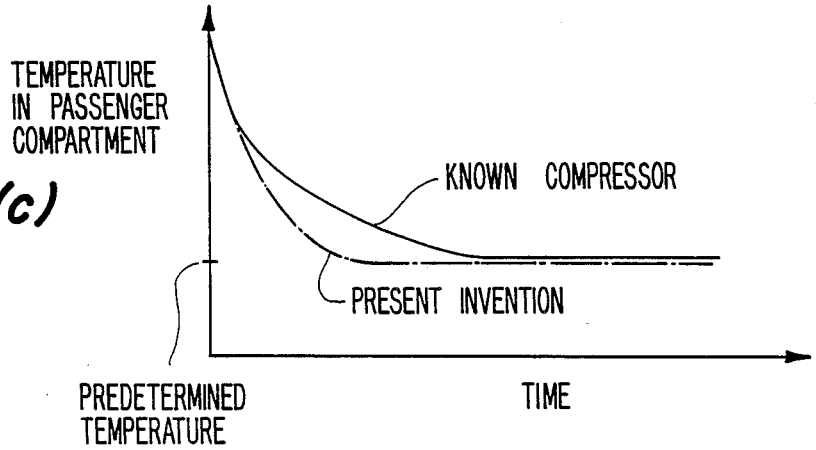

As mentioned above, the slant angle of inclined plate 10 is controlled by the pressure and temperature conditions of the refrigerant in the suction chamber. When conditions provide for fluid communication between suction chamber 40 and crank chamber 22, the slant angle increases and therefore so does the capacity. Therefore, the capacity of the compressor is controlled in accordance with actual environmental conditions, as shown in FIGS. 3(*a*) and 3(*b*), and the cooling characteristics for the compressor are improved, as shown in FIG. 3(*c*). FIG. 3(*a*) graphically illustrates that the suction pressure in the compressor of the present invention is lower than that of known variable displacement compressors. This improves the compressor's cooling characteristics. FIG. 3(*b*) shows that during the initial operation, the compressor of the present invention operates at a higher capacity to better cool the passenger compartment. FIG. 3(*c*) confirms that the compressor of the present invention attains a lower temperature faster than known compressors.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

What is claimed is:

1. A slant plate type refrigerant compressor for use in a refrigerant circuit comprising:

a compressor housing having a central portion, a front end plate at one end and a rear end plate at its other end, said housing having a cylinder block provided with a plurality of cylinders and a crank chamber adjacent said cylinder block, said rear end plate having a suction chamber and a discharge chamber;

a piston slidably fitted within each of said cylinders;

a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of said compressor; and a control device to vary the capacity of said compressor by adjusting the incline angle, said control device including at least one passageway communicating between said crank chamber and said suction chamber and two control means for controlling the pressure in said crank chamber by opening and closing said at least one passageway, said first control means controlling the pressure in said crank chamber responsive to the pressure in said suction chamber, and said second control means controlling the pressure in said crank chamber responsive to the temperature of refrigerant in said suction chamber, wherein said second control means comprises a mechanism that operates directly in response to the temperature of refrigerant in said suction chamber absent external inputs.

2. The refrigerant compressor of claim 1 wherein said first control means comprises a first bellows and a first valve element and said second control means comprises a second bellows and a second valve element.

3. The refrigerant compressor of claim 2 wherein the interior of said first bellows is maintained as a vacuum and said second bellows encloses a gas having a low saturated vapor pressure.

4. The refrigerant compressor of claim 1 wherein said control device comprises two said passageways, and said first control means controls the opening and closing of said first passageway, and said second control means controls the opening and closing of said second passageway.

5. The refrigerant compressor of claim 2 wherein said first and second passageways are formed within said cylinder block.

6. The refrigerant compressor of claim 4 wherein said first control means comprises a first bellows and a first valve element said second control means comprises a second bellows and a second valve element.

7. The refrigerant compressor of claim 6 wherein the interior of said first bellows is maintained as a vacuum and said second bellows encloses a gas having a low saturated vapor pressure.

8. The refrigerant compressor of claim 6 wherein said passageway is formed within said cylinder block.

9. The refrigerant compressor of claim 6 wherein said control means comprises a bellows, a needle valve, and a U-shaped sensing board comprising a bimetallic element.

10. A slant plate type refrigerant compressor for use in a refrigeration circuit comprising:

a compressor housing having a central portion, a front end plate at one end and a rear end plate at its other end, said housing having a cylinder block provided with a plurality of cylinders and a crank chamber adjacent cylinder block, said rear end plate having a suction chamber and a discharge chamber;

a piston slidably fitted within each of said cylinders;

a drive mechanism coupled to said pistons to reciprocate said pistons within said cylinders, said drive mechanism including a drive shaft rotatably supported in said housing, a rotor coupled to said drive shaft and rotatable therewith, and coupling means for drivingly coupling said rotor to said pistons such that the rotary motion of said rotor is converted into reciprocating motion of said pistons, said coupling means including a member having a surface disposed at an incline angle relative to said drive shaft, said incline angle of said member being adjustable to vary the stroke length of said pistons and the capacity of said compressor; and a control device to vary the capacity of said compressor by adjusting the incline angle, said control device including a passageway communicating between said crank chamber and said suction chamber and control means for controlling the pressure in said crank chamber by opening and closing said passageway responsive to the pressure and temperature of refrigerant in said suction chamber, wherein said control means comprises a mechanism that operates directly in response to the temperature of refrigerant in said suction chamber absent external inputs.

* * * * *